United States Patent [19]

Hotimsky

[11] 4,211,371

[45] Jul. 8, 1980

[54] DEVICE FOR THE BALANCED FIXING AND MOUNTING OF BLADES IN MACHINES PROVIDED TO CUT, CRUSH AND HASH

[76] Inventor: Eric P. L. Hotimsky, 24 allee des Chalets, Pavillons-sous-Bois, France

[21] Appl. No.: 936,765

[22] Filed: Aug. 25, 1978

Related U.S. Application Data

[63] Continuation of Ser. No. 808,917, Jun. 22, 1977, abandoned.

[30] Foreign Application Priority Data

Jun. 24, 1976 [FR] France ..... 76 19231
Apr. 19, 1977 [FR] France ..... 77 11758

[51] Int. Cl.[2] ..... B02C 18/16

[52] U.S. Cl. ..... 241/282.1; 83/699; 241/292; 241/292.1

[58] Field of Search ..... 241/199.5, 199.6, 199.7, 241/282.1, 292, 292.1; 83/654, 655, 664, 665, 699

[56] References Cited

U.S. PATENT DOCUMENTS

| | | | |
|---|---|---|---|
| 1,017,213 | 2/1912 | Hottmann | 241/282.2 X |
| 3,330,317 | 7/1967 | Schaller | 241/282.2 |
| 3,631,907 | 1/1972 | Laska | 241/292.1 |
| 3,937,408 | 2/1976 | Buck | 241/282.2 |

*Primary Examiner*—Howard N. Goldberg
*Attorney, Agent, or Firm*—Hauke and Patalidis

[57] ABSTRACT

Each blade comprises a recess into which enters a part fixed to a brace washer, said part ensuring a correct locking of the blade with respect to the washer, which permits, after piling up of the blades and washers on a shaft rotating either directly or with interposition of a sheath, the locking of the unit by means of conventional tightening means such as nuts or counter-nuts screwed on the threaded end portion of the driving shaft of the blades.

13 Claims, 10 Drawing Figures

DEVICE FOR THE BALANCED FIXING AND MOUNTING OF BLADES IN MACHINES PROVIDED TO CUT, CRUSH AND HASH

CROSS REFERENCE TO RELATED APPLICATION

This application is a continuation of application Ser. No. 808,917, filed June 22, 1977, and now abandoned.

The present invention relates to the mounting, fixing and balancing of blades used in machines provided to cut, crush, hash and reduce to soft paste food products, and particularly in machines usually used in pork-butchery or similar butchery to cut and hash meat by means of a certain number of blades having substantially a crescent shape mounted on a same shaft but angularly off-set in order of obtaining, on a certain length, a positioning of a plurality of blades which cut, crush and hash the considered products.

Most of the known machines are constituted by a vat in the shape of a half-tore in which rotates, at high speed, a certain number of blades mounted on a shaft, of generally horizontal extension. On the same vat can be mounted, in some cases, several shafts, each of them supporting sets of blades. Besides, the vat rotates slowly around its vertical axis.

In modern machines, the rotation speed of the blades has always been increasing and, whereas originally the blades rotated at about 1,000 rpm, now they rotate at nearly 3,000 and 4,000 rpm, and sometimes at 10,000 rpm. This development of the technology has given a considerable importance to some phenomena which, in the original machines, were negligible.

The centrifugal force generated by an extremely fast rotation of the blades tends to move the same, and sometimes succeeds in doing so, with all the desastrous consequences that can be thought: breakage of the blades, deep scratches in the vat, products under treatment becoming unusable due to the presence therewith of metal chips and which have to be thrown away; yet it is frequent to treat at one time several hundreds of kilograms of products.

Vibrations also appear if the blades are not carefully balanced which is often the case due to the difficulty to realize this balance. Actually, if the weight of new blades is relatively regularly balanced, substantial differences appear rapidly and progessively at each sharpening, said differences can reach several tens of grams.

The vibrations which are thus caused lead to a fast deterioration of the balls of the shaft supporting the blades, which involves high repair costs, a general fatigue of the material and also, nearly permanently, a deafening noise when the machine operates.

The present invention copes with said disadvantages by creating a simple means for blocking the blades on the intermediate washers thus enabling the correct placing and tightening of the blades on the rotative shaft while ensuring the fool-proof position thereof.

Besides, the present invention also copes with the disadvantages caused by the unbalancing, in creating a device enabling to position balancing components which are easy to adjust and with which can be realized sets of balanced blades mounted on sheaths which can be placed directly on the drive shaft of the machine used to cut, crush, hash; these sets after having being positioned being tightened on the shaft by usual means.

According to the invention, each blade comprises a part which penetrates in an arcuate channel of a washer, said part ensuring a correct locking of the blade with respect to the washer, which permits, after piling up of the blades and washers on a shaft rotating either directly or with interposition of a sheath, the locking of the so made unit by means of conventional tightening means such as nuts or counter-nuts screwed on the threaded end portion of the driving shaft of the blades.

According to another feature of the invention, each blade is slipped on an intermediate sheath and first receives a brace washer or an adjusting washer, then a counterweight washer placed near the central area of the blade and then a washer for adjusting the counterweight washer, the counterweight washer comprising a lug cooperating with an arcuate aperture bent in spiral and suitably bored in the adjusting washer of the counterweight washer, being noted that the counterweight washer has in its center an opening of an elongated shape enabling to engage it on the intermediate sheath without the counterweight washer being able to rotate on the sheath.

According to still another feature of the invention, the washer for adjusting the counterweight washer is bored in its center with a circular boring at least equal to the larger diameter of the sheath.

Various other features of the invention are shown in the following detailed description.

Embodiments of the object of the invention are shown, by way of example, in the accompanying drawings, wherein.

Figure 1:
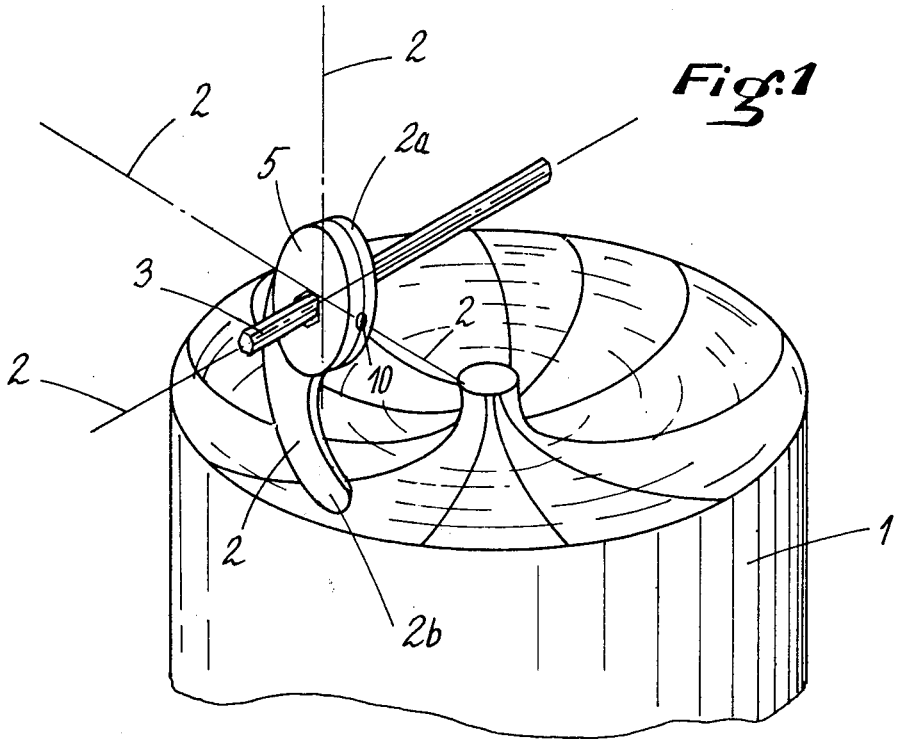
FIG. 1 is a partial perspective view of an apparatus provided to cut, crush and hash pieces of meat, showing the radial arrangement of various blades, said blades being separated by one or several washers.

In FIG. 1 there is partially shown a vat 1 of an apparatus provided to cut, crush, hash meat by means of blades 2 (of which only one is fully shown the other blades being only shown by their axes) radially placed with respect to the rotating shaft 3 mounted above the vat 1 and rotatively driven in direction of the arrow $F_1$ (FIG. 2) by a motor (not shown).

Figure 2:
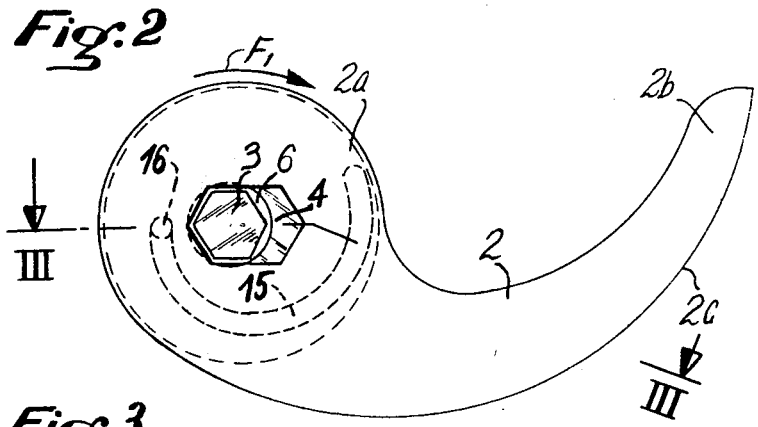
FIG. 2 is a plane view of a blade with the washer permitting to adjust the blade.

The blades 2 are of a conventional type for such machines and have, as it can be seen both in FIG. 1 and in FIG. 2, a crescent shape of which the end portion 2*a* is substantially cylindrical, while the end portion 2*b* becomes thinner and the edge 2*c* is sharp having been suitably sharpened. The central shaft 3 comprises a stop means (not shown) for limiting the position of the first blade, then this shaft, of a polygonal shape, receives a plurality of blades 2 of which the circular portion 2a, bored with a polygonal elongated aperture 4, permits to correctly place the two blades 2 on the shaft 3. Between each blade there is mounted at least one washer 5 of a cylindrical shape also bored in its center with an appropriate opening 6 enabling to place it on the shaft 3.

Figure 3:
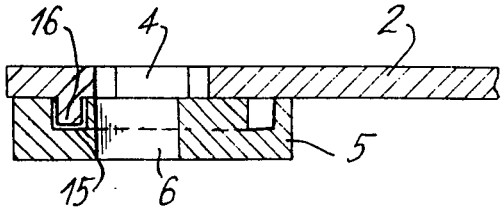
FIG. 3 is a sectional view substantially taken along the line III—III of FIG. 2.

As shown in FIGS. 2 and 3, the considered blade 2 comprises a lug 16 placed in the back portion of the blade, nearly in prolongation of the polygonal elongated aperture 4. An arcuate opening 15, in the shape of a suitable spiral, is machined in the washer 5 to receive the lug 16 of the blade 2. After slipping the blade and washer 5 on the driving shaft 3 of the machine, the blade 2 is positioned by more or less rotating the washer 5 (by means of a pin inserted in a hole 10 of the washer), which causes a translation motion of the lug 16 of the blade 2 and consequently a translation motion of the blade 2 itself thereto. Since this translation motion can occur only if the washer 5 can rotate on itself, the blade is held in an unchanging position as soon as the assembly of the blades and washers is tightened in a well known way on the shaft 3, for example by means of a nut.

The correct positioning of the lugs 16 ensures the final locking of the blades 2 in spite of the stress applied thereon by the centrifugal force due to the high rotation speed of the shaft 3.

This device for a relative holding of the blades with respect to the driving shaft is simple, not costly and safe.

Figure 4:
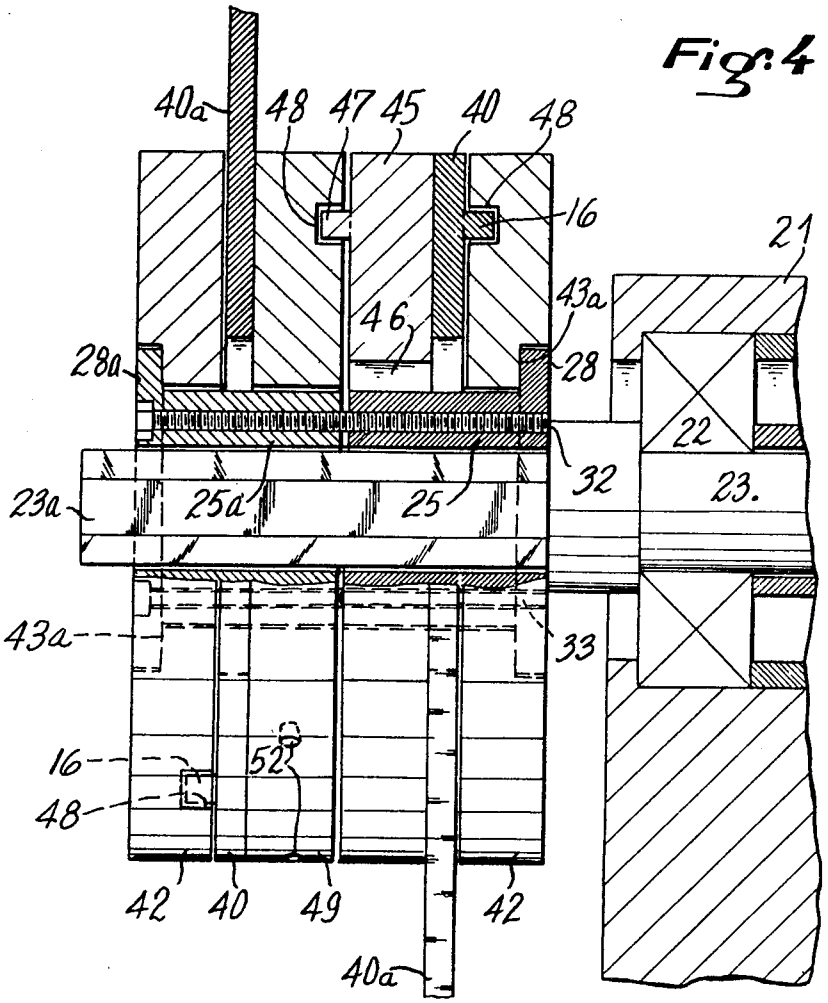
FIG. 4 is an elevation view, partly in cross section, of the device of the invention, mounted on an intermediate sheath.

In FIG. 4 there has been shown a sub-assembly under mounting:

The right portion of the drawing diagrammatically shows a support 21 in which are placed ball-races 22 holding a shaft 23 freely rotating in a support 21; this shaft 23 has the same characteristics as to the shape and the size as that of the drive shaft 3 of the machine. A sheath 24 (FIG. 10) is slipped on the shaft 23 (FIG. 4) and has two similar elements 24a and 24b each of them composed of a cylindrical portion 25 having two diametrically opposite flat portions 26, 27, and at one end a collar or flange 28. Two diametrically opposite channels 29, 30 are bored in the element 25 which is, lastly, bored in its center with a polygonal channel 31. The element 25a is similar to the element 25, but its collar or flange 28a is fixed onto its other end. While the channels 29, 30 are threaded, the channels bored in the element 25a are smooth and are used as guides for long screws 32, 33 to be screwed in the threaded channels 29, 30 by rotating the heads 32a and 33a of the screws 32, 33.

Figure 5:
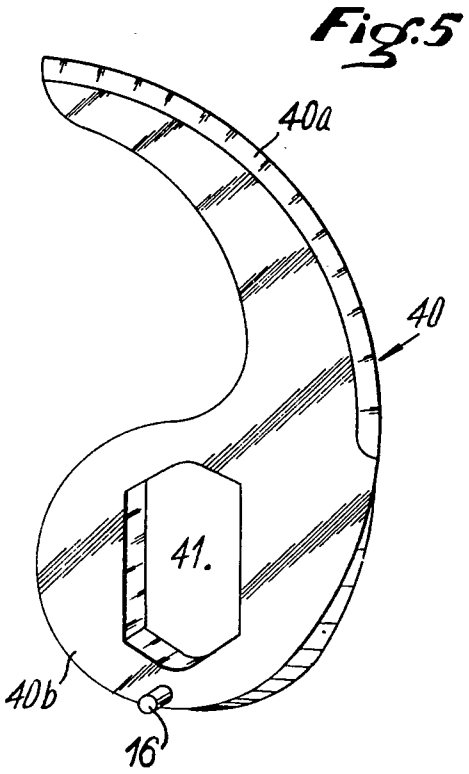
FIG. 5 is a plane view of a blade.

In FIG. 5, there has been shown a blade 40 similar to the blade 2 of FIG. 2 and which has the shape of a crescent with a cutting edge 40a. This blade is ended by a substantially cylindrical portion 40b bored in its center with an aperture 41 enabling it to be mounted on the element 25 or 25a of the sheath 24 (FIG. 10) while letting the possibility of a certain clearance perpendicularly to the axis of the sheath 24 while not enabling its rotation, with respect to the sheath 24.

Figure 6:
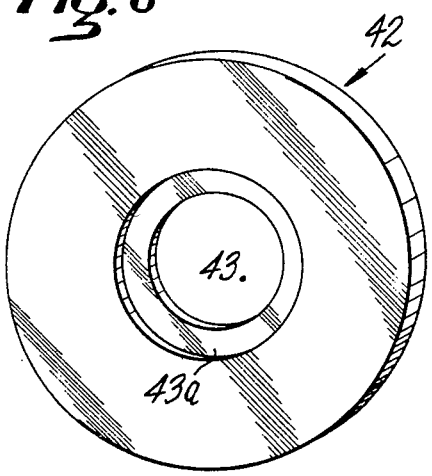
FIG. 6 is a perspective view of one of the sides of a washer used in the invention.
Figure 10:
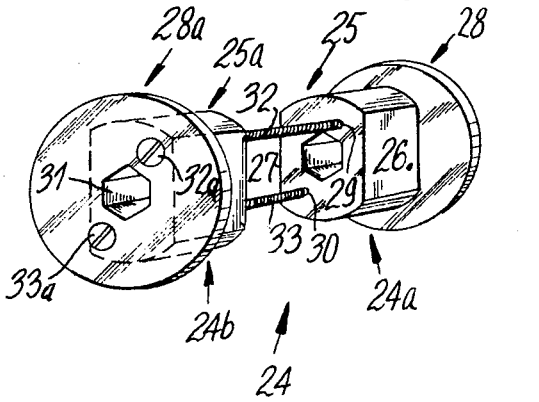
FIG. 10 is a perspective view of the intermediate sheath on which are mounted the blades and the various washers.

In FIG. 6, there has been shown a brace washer 42 bored in its center with a channel 43 having at least the diameter of the central cylindrical portion 25, 25a of the sheath 24 (FIG. 10). Besides a recess 43a is provided, on one side of the washer 42, for housing one of the collars 28 or 28a (FIG. 10) when said washer is mounted onto the sheath. The blade 40 (FIG. 5) and the brace washer 42 can, in some cases, comprise components enabling to adjustably hold in a safe way the blade in a certain position on the sheath 24. Then the brace washer 42 becomes an adjusting washer.

Figure 8:
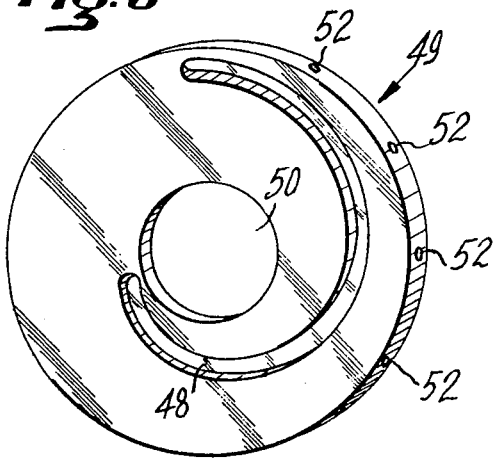
FIG. 8 is a perspective view of the other side of the washer of FIG. 6 when used as an adjusting washer.

In that case, according to a possible embodiment of the invention, the side of the washer 42 non viewable in FIG. 6 is as shown in FIG. 8, that is it comprises an arcuate aperture bent according to a suitable spiral, which is similar to the washer 5 of FIGS. 1-3.

Figure 7:
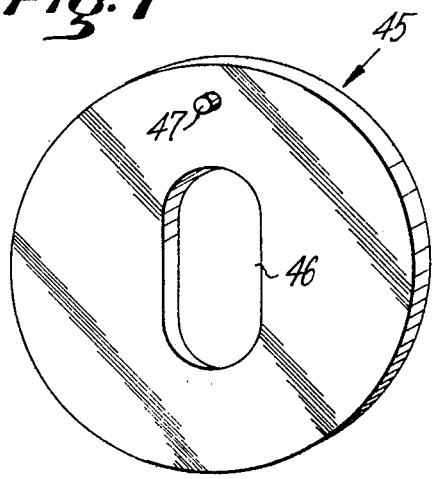
FIG. 7 is a perspective view of a counterweight washer.

In FIG. 7, there is shown the counterweight washer 45 bored with an elongated aperture 46 of a side size slightly greater than the side size of the central portions 25, 25a of the sheath 24 (FIG. 10) in order not to be able to rotate with respect to this sheath, but to be able to slightly move transversally through sliding. The counterweight washer 45 comprises a lug or a piece 47 whose position is selected to penetrate into the spiral channel 48 bored in one of the sides of a washer 49 (FIG. 8) for the adjustment of the counterweight washer.

In FIG. 8 there has been shown an adjusting washer 49 on the side where is bored an arcuate aperture 48 bent according to a suitable spiral, provided to receive either the lug 16 of a blade 2 (FIG. 2) in order to ensure the unchangeable positioning and fixing of the blade, or the lug 47 of a counterweight washer 45 (FIG. 7) in order to ensure the unchangeable positioning and fixing thereof. This washer 49 comprises in its center a circular bore 50 of a diameter equal to the cylindrical outer diameter of the portions 25, 25a of the sheath 24 (FIG. 10). Besides, the holes 52 are bored in the sides of the washers 49 at equal distance from each other.

Figure 9:
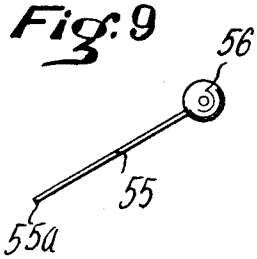
FIG. 9 is a perspective view of the adjusting tool of the counterweight washer.

In FIG. 9 there has been shown a tool in the form of a pin 55 comprising a rod ended by an operating button 56, the end 55a of this rod being able to easily penetrate in the holes 52 bored in the sides of the adjusting washers 49 (FIG. 8).

When, for instance, it is desired to mount two blades on the sheath 24, the two elements 24a, 24b are first separated by unscrewing the long screws 32, 33. On the element 25 there is placed, at first, a brace washer 42 or an adjusting washer 49, directed in such a way that the recess 43a will mate the collar 28 (see FIG. 4). There is then placed a blade 40, for example in downwardly directing its cutting portion 40a, there is then mounted behind the first blade 40 a counterweight washer 45 comprising a lug 47. On the portion 25a of the sheath is placed a brace washer 42 or an adjusting washer 49, directed in such a way that the recess 43a will mate the collar 28a, then another blade 40 of which the cutting edge is upwardly directed, and then a new adjusting washer 49 for adjustment of the counterweight washer 45. Then the two elements 25 and 25a are brought close to each other by means of the screws 32, 33 while tightening very slightly the assembly, but sufficiently for the same to become an integral unit and for the lug 47 of the counterweight washer 45 to penetrate only in a point of the spiral channel 48 bored in one of the sides of the adjusting washer 49 placed against the counterweight washer 45.

The sheath 24 is then slipped on the outer portion 23a of the shaft 23. Since the shaft 23 is freely mounted in the support 21, the whole unit can easily rotate and, if an untrue balance exists, the assembly will stop with the heaviest blade 40 of said assembly being directed Jownwards, and it is then possible, by means of the tool 55 inserted into the holes 52 of the adjusting washer 49 to rotate more or less throw off center the counterweight washer 45 since the same is driven in the throwing off motion by its lug 47 placed in the spiral channel 48 of the adjusting washer 49; it is thus proceeded by trial and error, up to when the unit is balanced, with all the blades then stopping in an undetermined position after rotation of the assembly.

The assembly is then tightened by suitably rotating the screws 32, 33 and is ready to be used on the rotating shaft of a machine provided to cut, crush, hash, etc.

Generally, the adjustment of the assembly balancing is made after a previous setting of the length of the blades, realized in using a stop member (not shown) which is set in relation with the shaft 23.

In some cases, according to the type of the machine used or according to the work to be performed, it is possible to mount only one blade on a sheath 24. There are then used two or three of these sheaths 24 entirely mounted but each of them having only one blade which have to be positioned on an adjusting shaft to balance the unit.

Its is also possible to provide groups of more than two blades on a sheath 24, but then it is preferred that the sheath will have a polygonal outer shape enabling arrangements ensuring, on one hand, a perfect locking of the blades with respect to this sheath and, on the other hand, the balancing of the blades.

I claim:

1. A structure for adjustably mounting blades on a drive shaft in industrial machines adapted to cut, crush and hash food products, said structure comprising at least two blades separated by at least one adjusting washer, at least one of said blades having an elongate opening with a median axis accepting therethrough said drive shaft for driving by said drive shaft while permitting radial displacement of said blade relative to said drive shaft, said blade comprising on one side thereof a protruding portion substantially aligned with said median axis, said adjusting washer having a substantially circular aperture accepting therethrough said drive shaft and an arcuate channel in the shape of a spiral in which penetrates the protruding portion of said blade, and means adjustably rotating said adjusting washer relative to said blade for moving the protruding portion in said arcuate channel for radially displacing said blade relative to said shaft, said blades and washers being mounted on said shaft and held thereon by means of conventional tightening means such as nuts and counternuts mounted on said shaft.

2. The structure of claim 1 wherein said blades are further separated by a brace washer.

3. The structure of claim 1 wherein the shaft comprises mounted thereon a counterbalancing set comprising a counterweight washer and a second adjusting washer, said counterweight washer having an elongate opening with a median axis and comprising on one side thereof a protruding portion substantially aligned with said median axis and penetrating in the arcuate channel of said second adjusting washer, and means rotating said adjusting washer for moving the protruding portion in said arcuate channel for radially displacing said counterweight washer relative to said shaft.

4. The structure of claim 3 wherein said second adjusting washer comprises holes bored at equal distance from each other in the periphery of said second adjusting washer so as to rotate said second adjusting washer by way of a tool introduced in said holes and move the protruding portion of the counterweight washer in the arcuate portion of the adjusting washer to adjust and position the counterweight washer.

5. The structure of claim 1 wherein said means rotating said adjusting washer comprises holes bored at equal distance from each other in the periphery of the adjusting washer so as to rotate said adjusting washer by way of a tool introduced in said holes and move the protruding portion of the blade in the arcuate portion of the adjusting washer to adjust and position the blade.

6. A structure for the balanced fixing and adjustable mounting of rotative blades on the drive shaft of an industrial machine adapted to cut, crush and hash food products, said structure comprising an intermediate sheath fixedly mounted of respectively said blade and said counterweight washer in the arcuate channel of respectively said first and second adjusting washers in which each said protruding portion penetrates for adjusting the radial position of respectively said blade and said counterweight washer, and means for tightening the end elements of said intermediate sheath toward each other.

7. The structure of claim 6 wherein said means rotating said first adjusting washer comprises holes bored at equal distance from each other in the periphery of the first adjusting washer so as to rotate said first adjusting washer by way of a tool introduced in one of said holes and move the protruding portion of the blade in the arcuate channel of the first adjusting washer to adjust and position the blade.

8. The structure of claim 6 wherein said means rotating said second adjusting washer comprises holes bored at equal distance from each other in the periphery of the second adjusting washer so as to rotate the second adjusting washer by way of a tool introduced in one of said holes and move the protruding portion of the counterweight washer in the arcuate channel of the second adjusting washer to adjust and position the counterweight washer.

9. The structure of claim 6 wherein said intermediate sheath is made of two portions each comprising one of said end flange elements and adjustably connected together by long screws placed in diametrically opposite channels.

10. The structure of claim 6 further comprising a second blade disposed adjacent to said second adjusting washer and a third adjusting washer disposed adjacent to said second blade over said intermediate sheath, said second blade having an elongate opening with a median axis enabling radial relative displacement between said second blade and said intermediate sheath and preventing said second blade from rotating relative to said intermediate sheath, said second blade having on one side thereof a protruding portion substantially aligned with said median axis, said third adjusting washer having an arcuate channel in the shape of a spiral in which penetrates the protruding portion of said second blade, and means rotating said third adjusting washer for moving the protruding portion of said second blade in the arcuate channel in which it penetrates for adjusting the radial position of said second blade.

11. The structure of claim 10 wherein said means rotating said third adjusting washer comprises holes bored at equal distance from each other in the periphery of the third adjusting washer so as to rotate said third adjusting washer by way of a tool introduced in one of said holes and move the protruding portion of the second blade in the arcuate channel of the third adjusting washer to adjust and position the second blade.

12. The structure of claim 10 wherein said means rotating said second adjusting washer comprises holes bored at equal distance from each other in the periphery of the second adjusting washer so as to rotate the second adjusting washer and move the protruding portion of the counterweight washer in the arcuate portion of the second adjusting washer to adjust and position the counterweight washer.

13. The structure of claim 10 wherein said intermediate sheath is made of two portions each comprising one of said end flange elements and adjustably connected together by lone screws placed in diametrically opposite channels.

* * * * *